US005992376A

United States Patent [19]

Okada et al.

[11] Patent Number: 5,992,376

[45] Date of Patent: Nov. 30, 1999

[54] ENGINE-BRAKE ASSISTING SYSTEM

[75] Inventors: Seiji Okada, Kawasaki; Takashi Takahashi, Tokyo, both of Japan

[73] Assignee: Mitsubishi Jidosha Kogyo Kabushiki Kaisha, Tokyo, Japan

[21] Appl. No.: 08/948,580

[22] Filed: Oct. 10, 1997

[30] Foreign Application Priority Data

Oct. 11, 1996 [JP] Japan ..... 8-269756
Oct. 11, 1996 [JP] Japan ..... 8-269757

[51] Int. Cl.[6] ..... F02D 13/04

[52] U.S. Cl. ..... 123/321

[58] Field of Search ..... 123/320, 321, 123/322, 324, 90.15, 90.16, 90.22, 90.27, 90.39

[56] References Cited

U.S. PATENT DOCUMENTS 3,786,792 1/1974 Pelizzoni et al. ..... 123/321
5,036,810 8/1991 Meneely ..... 123/321
5,105,782 4/1992 Meneely ..... 123/321
5,645,031 7/1997 Meneely ..... 123/322
5,701,857 12/1997 Hara ..... 123/90.16
5,803,038 9/1998 Ihara et al. ..... 123/321
5,809,952 9/1998 Ono et al. ..... 123/90.16

FOREIGN PATENT DOCUMENTS 3-47410 7/1991 Japan .

*Primary Examiner*—Willis R. Wolfe
*Assistant Examiner*—Hieu T. Vo

[57] ABSTRACT

In an engine-brake assisting system comprising a hydraulic pressure producing unit, an exhaust valve driving unit and a hydraulic circuit member which are constructed as discrete elements, the hydraulic pressure producing unit produces a desired hydraulic pressure by rotating a camshaft disposed on a cylinder head to drive an engine-brake assisting cam. The generated hydraulic pressure is then supplied to an exhaust cam of the exhaust valve driving unit, which causes exhaust valves to open and close at a timing different from a valve opening and closing timing during a normal operation, thereby giving the engine a large brake force. With this arrangement, the reduction of overall size of the system and consequent reduction of overall height of an engine can be achieved.

4 Claims, 8 Drawing Sheets

ENGINE-BRAKE ASSISTING SYSTEM

BACKGROUND OF THE INVENTION a) Field of the Invention

This invention relates to an engine-brake assisting system which makes it possible to obtain large engine brake force by opening and closing an exhaust valve of an engine at a timing different from that employed during a normal operation.

b) Description of the Related Art

As one of engine brake systems, an engine-brake assisting system has already been developed and commercialized. According to this engine-brake assisting system, an exhaust valve is opened and closed at a timing different from a normal exhausting timing when an accelerator is off, whereby a state of pressure within a cylinder is controlled to increase the ability of engine brake.

Such engine-brake assisting systems have been applied primarily to heavy vehicles such as large trucks and buses. In particular, such an engine-brake assisting system is used in combination with an exhaust brake system to produce strong engine brake force when an accelerator is off, thereby making it possible to obtain large braking force while reducing the load on a service brake.

A brief description will now be made of the operation principle of the above-mentioned engine-brake assisting system. During operation of this brake system, an intake valve and an exhaust valve are opened and closed, for example, in a manner described hereinafter.

In an intake stroke, the intake valve is opened as usual so that inducted air is introduced. In a compression stroke, both the intake valve and the exhaust valve are closed also as in an ordinary operation, and the inducted air within the cylinder is compressed.

Next, immediately before advancing from the compression stroke to an expansion stroke, the exhaust valve is opened to exhaust the compressed inducted air into an exhaust port by way of the exhaust valve. Repulsive force of the inducted air, which has been compressed in the compression stroke, no longer acts on a piston so that in the expansion stroke, no force acts in such a direction as pushing down the piston.

Further, after the exhaustion of the compressed air, the exhaust valve is closed near a top dead center to maintain the cylinder in a closed state during the expansion stroke. As a consequence, force is produced in such a way as preventing the piston from moving downward, resulting in application of engine brake force.

When the piston next reaches near a bottom dead center and the engine advances to an exhaust stroke, the exhaust valve is opened as usual to bring the internal pressure of the cylinder close to atmospheric pressure. When the piston subsequently reaches near the top dead center, an intake stroke is started again.

By repeatedly conducting such operation, brake forces in compression strokes and expansion strokes successively act on the piston, whereby the ability of engine brake is significantly increased. In other words, the engine is caused to perform pumping operation as negative work so that kinetic energy of a vehicle is absorbed and converted into braking force.

Incidentally, fuel injection is stopped during operation of such an engine-brake assisting system.

One example of such an engine-brake assisting system as described above is disclosed, for example, in Japanese Patent Application Laid-Open (Kokai) No. SHO 60-252113. With reference to FIG. 6 to FIG. 8, a brief description will now be made about the specific construction of such an engine-brake assisting system. A valve system of this engine is provided with an OHC valve train having a camshaft arranged on a cylinder head. Each cylinder is provided with intake valves 142,143 and exhaust valves 144,145.

A valve bridge (which may also be called an "intake crosshead") 146 is arranged over the intake valves 142,143, while another valve bridge (which may also be called an "exhaust crosshead") 147 is disposed over the exhaust valves 144,145.

Over these valve bridges 146,147, an intake rocker arm 149 and an exhaust rocker arm 150, both rockably supported on a rocker shaft 148, are arranged respectively in such a way that these arms are maintained at one ends thereof in contact with the corresponding bridges. During a normal operation of the engine, the intake valves 142,143 and the exhaust valves 144,145 are opened and closed in accordance with operation of the corresponding rocker arms 149,150.

The camshaft, which is designated at numeral 151, is provided with an intake cam 152 and an exhaust cam 153. The intake cam 152 and exhaust cam 153 are formed in such cam profiles as making the respective rocker arms 149,150 operate at a timing suited for the normal operation.

Further, as is illustrated in FIG. 6, a cylinder housing 111, as an essential element of the engine-brake assisting system, is arranged over the cylinder head, extending across the rocker shaft 148. Formed integrally with this cylinder housing 111 are a master cylinder 112, a slave cylinder 113, and a high-pressure fluid line (fluid line) 116 (FIG. 8) connecting the master cylinder 112 and slave cylinder 113 in communication with each other.

On the camshaft 151, an engine-brake assisting cam 138 is also arranged in addition to the above-mentioned intake and exhaust cams 152,153. By this engine-brake assisting cam 138, a master piston 125 disposed within the master cylinder 112 is reciprocally driven. Incidentally, the engine-brake assisting cam 138 is formed in such a cam profile that it drives the master piston 125 when the piston of the engine is located near the top dead center in a compression stroke.

On the other hand, a slave piston 129 is inserted within the slave cylinder 113 as depicted in FIG. 8. When working fluid is supplied through the high-pressure fluid line 116, the slave piston 129 is therefore driven responsive to operation of the master piston 125.

As is illustrated in FIG. 6 and FIG. 8, a piston rod 130 is also arranged underneath the slave piston 129. A lower end of this piston rod 130 is in contact with an upper end of the exhaust valve 145. Accordingly, when the slave piston 129 moves downward, the exhaust valve 145 is opened by way of the piston rod 130 irrespective of a state of operation of the exhaust rocker arm 150.

A directional control valve (solenoid valve) 114 is also arranged inside the cylinder housing 111 as shown in FIG. 6 and FIG. 8. As is illustrated in FIG. 8, control of this solenoid valve 114 makes it possible to change over the communication mode between two modes, one being a mode in which a working fluid supply line 136 and the high-pressure fluid line 116 are connected in communication with each other through a passage 35, and the other mode in which the high-pressure fluid line 116 and a working fluid return line 137 are connected in communication with each other through the passage 35.

Upon operation of the engine-brake assisting system of such a construction, fuel injection by an unillustrated fuel injection valve is stopped, and the solenoid valve 114 is changed over to connect the working fluid supply line 136 and the high-pressure fluid line 116 in communication with each other.

As a result, the high-pressure fluid line 116 is filled up with high-pressure working fluid. In this case, driving of the master piston 125 by the engine-brake assisting cam 138 leads to driving of the slave piston 129 by way of the high-pressure working fluid, whereby the exhaust valve 145 is opened near the top dead center in a compression stroke.

Accordingly, immediately before an advancement of the engine from a compression stroke to an expansion stroke, the exhaust valve 145 is opened and the compressed inducted air is exhausted by way of the exhaust valve 145. The repulsive force of the inducted air, which has been compressed in the compression stroke, therefore no longer acts on the piston, so that no force acts in such a direction as pushing down the piston in the expansion stroke.

Since the exhaust valve 145 is closed subsequent to the exhaustion of the compressed air, the inside of the cylinder is brought into a closed state in the expansion stroke. As a consequence, force is produced in such a way as preventing the piston from moving downward, resulting in application of engine brake force.

In such a conventional engine-brake assisting system, the housing 111 is, however, formed as an integral unit. The system hence becomes large as a whole, leading to a problem that the overall height of an engine becomes great.

Especially during operation of such an engine-brake assisting system as mentioned above, a large load is exerted on each member. The housing 111 is therefore required to have strength sufficient to withstand such large loads. From this requirement, the housing 111 also becomes large, resulting in another problem that the overall weight of the system increases.

According to the technique as described above, each cylinder is provided with its own solenoid valve 114 for changing over the engine-brake assisting system between an operation mode and a non-operation mode. Corollary to this, solenoid valves 114 are needed as many as cylinders, resulting in a further problem that the manufacturing cost is increased.

Moreover, each cylinder has to be provided with its own working fluid supply line 136 and working fluid return line 137, leading to a still further problem that the working manhour is increased and the manufacturing cost is also increased accordingly.

SUMMARY OF THE INVENTION

With the foregoing problems in view, an object of the present invention is to provide an engine-brake assisting system, which permits a reduction in the overall size of the system, and further a reduction in the overall height of an engine while retaining sufficient strength for each member.

Another object of the present invention is to provide an engine-brake assisting system, which permits a reduction in manufacturing cost by reducing the number of solenoid valves, which are required for changing over the engine-brake assisting system between an operation mode and a non-operation mode, and also by commonly using the same working fluid supply line among cylinders.

In one aspect of the present invention, there is thus provided an engine-brake assisting system provided with:

a camshaft arranged on a cylinder head of the engine, an exhaust cam arranged on the camshaft for driving an exhaust valve via an exhaust rocker arm, a rocker shaft rockably supporting the exhaust rocker arm thereon, and an engine-brake assisting cam arranged on the camshaft adjacent to the exhaust cam, said system comprising:

a hydraulic pressure producing unit for producing a desired hydraulic pressure responsive to actuation of the engine-brake assisting cam, a hydraulic circuit member connected on a side of an end thereof with the hydraulic pressure producing unit and arranged astride the rocker shaft, and an exhaust valve driving unit to which the hydraulic circuit member is connected on a side of an opposite end thereof so that by the hydraulic pressure supplied from the hydraulic pressure producing unit, the exhaust valve is opened at a timing different from a valve-opening timing of the exhaust cam;

wherein the hydraulic pressure producing unit and the exhaust valve driving unit are constructed as discrete elements.

According to this construction, the shape, size, material, and the like of the hydraulic circuit member can be set irrespective of the hydraulic pressure producing unit or the exhaust valve driving unit, so that they can be chosen to fully achieve the inherent function of the hydraulic circuit member, namely, to supply a hydraulic pressure, which is produced at the hydraulic pressure producing unit, to the exhaust valve driving unit. In addition, there is another advantage that increases in the overall height and weight of the engine can be reduced.

Described specifically, the conventional engine-brake assisting system is accompanied by the problem that the overall height and weight of the engine become greater because a master cylinder, and a slave cylinder and a fluid line connecting these master cylinder and slave cylinder with each other are constructed by an integral housing. The system of the present invention makes it possible to provide an engine-brake assisting system without using such an integral housing, so that increases in the overall height and weight of the engine can be reduced substantially.

Preferably, the hydraulic pressure producing unit is arranged on a bottom wall of a rocker compartment in which the camshaft is accommodated.

This construction has an advantage that the mounting position of the hydraulic pressure producing unit can be lowered and the overall height of the engine can be lowered further. Further, it is no longer necessary to support the hydraulic pressure producing unit by the hydraulic circuit member. This makes it possible to form the hydraulic circuit member smaller or to form it with a light-weight material.

Further, the bottom wall of the rocker compartment may be formed as a bottom wall of a rocker case which is in turn formed integrally with a bearing for the camshaft. In this case, there is an advantage that the accuracy of relative mounting positions between the hydraulic pressure producing unit and the camshaft can be enhanced.

The exhaust valve driving unit may be fastened together with an upper member of the bearing on the cylinder head by common bolts. This makes it possible to reduce the number of bolts, thereby bringing about an advantage that the overall weight of the engine, the number of parts, and the assembling manhour can be all reduced.

In addition, the engine may have a plurality of cylinders. Each of the cylinders may be provided with its own working fluid supply unit composed of the hydraulic pressure producing unit, the exhaust valve driving unit, and the hydraulic circuit member. The system may further comprise a fluid pump for producing a desired hydraulic pressure by driving force of the engine, a main hydraulic pressure line communicating with the fluid pump, a like plural number of working fluid lines branching from the main hydraulic pressure line and communicating with the exhaust valve driving units, respectively, a solenoid valve arranged on the main hydraulic pressure line so that the main hydraulic pressure line can be opened or closed, and a like plural number of control valves arranged on the working fluid lines, respectively, so that working fluid is supplied to the working fluid supply units when the working fluid is supplied from the fluid pump and the working fluid in the working fluid supply units is drained when the supply of the working fluid from the fluid pump is cut.

According to this construction, the working fluid can be supplied by the single solenoid valve to the working fluid supply units of the individual cylinders, thereby bringing about an advantage that the number of solenoid valves, which are costly, bulky, and heavy, can be reduced. Described specifically, the number of solenoid valves which have heretofore been required as many as the number of cylinders can be reduced, leading to advantages that the retention of space is no longer required for the arrangement of such many solenoids and the manufacturing manhour and cost can be reduced owing to the reduction in the number of parts.

Further, discrete arrangement of the solenoid valve relative to the hydraulic pressure producing unit, the exhaust valve driving unit, and the hydraulic circuit member makes it possible to commonly use the hydraulic pressure producing unit, the exhaust valve driving unit and the hydraulic circuit member for the individual cylinders. This can also reduce the manufacturing cost.

DESCRIPTION OF THE PREFERRED EMBODIMENT

With reference to the drawings, the engine-brake assisting system according to one embodiment of the present invention will be descried hereinafter.

Figure 1:
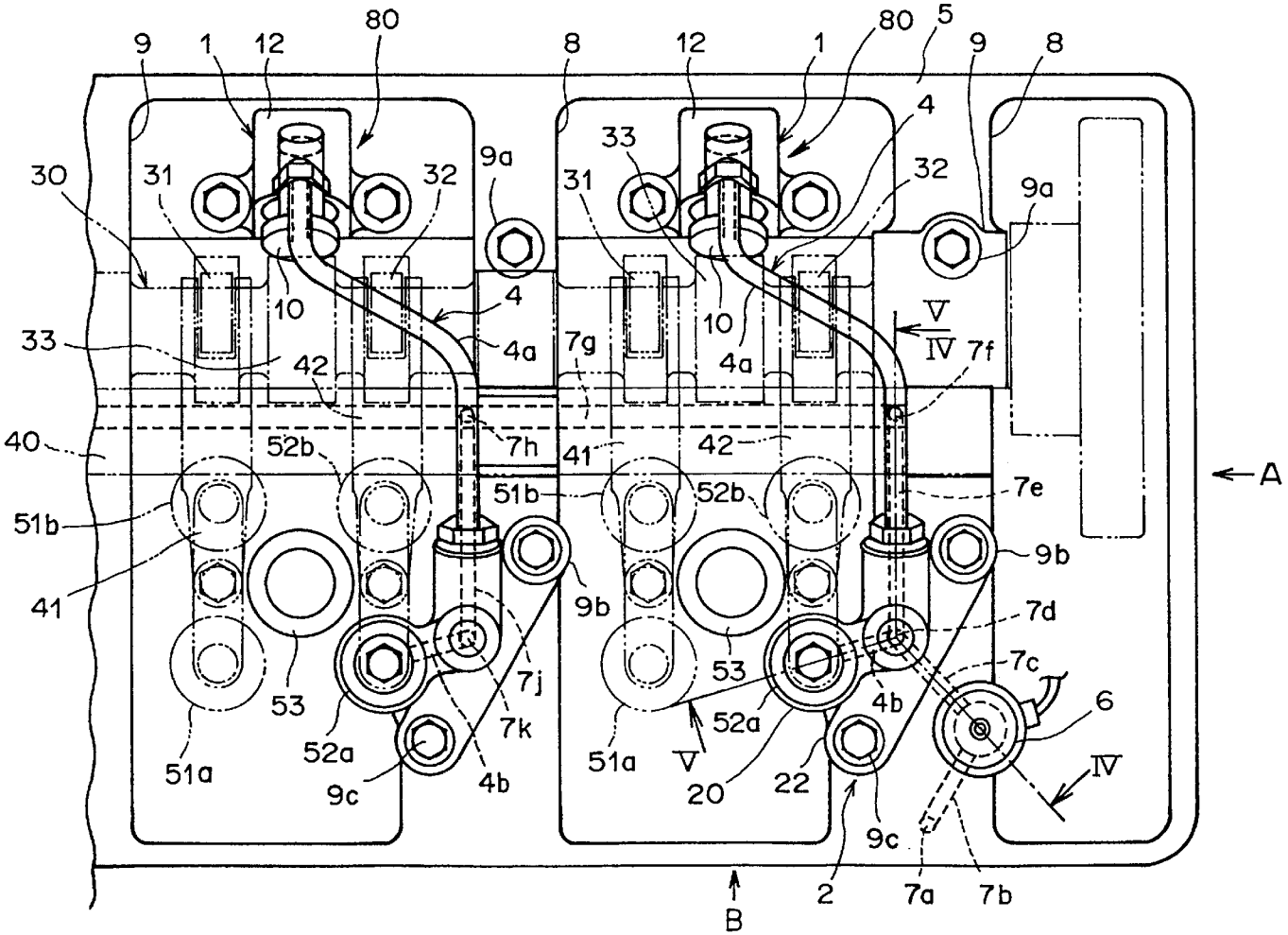
FIG. 1 is a top plan view schematically illustrating a section of an engine equipped with an engine-brake assisting system according to one embodiment of the present invention.
Figure 2:
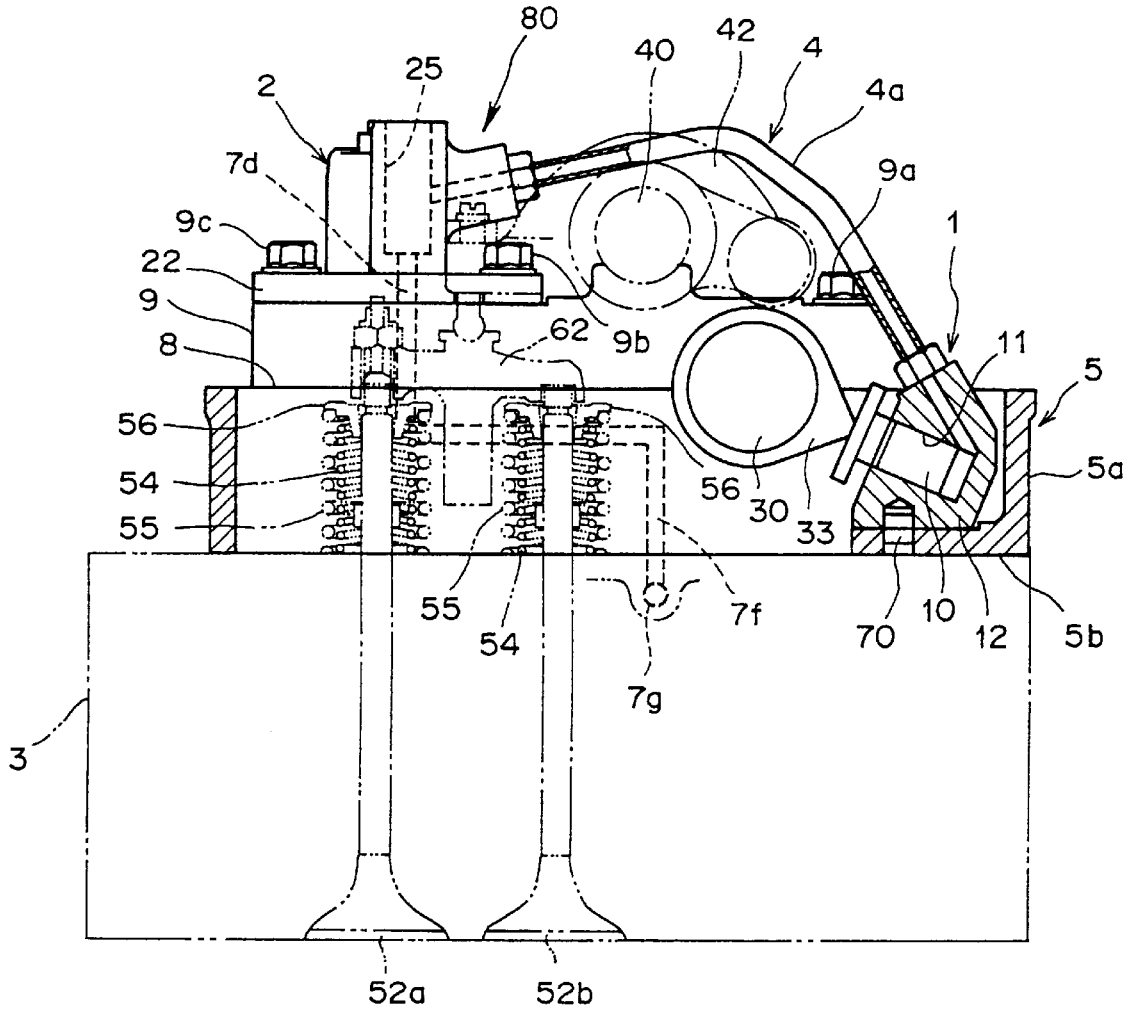
FIG. 2 is a side view schematically showing the engine equipped with the engine-brake assisting system according to the one embodiment of the present invention, and is a figure as viewed in the direction of arrow A of FIG. 1.

Firstly, a brief description will be made about the basic construction of the engine. As is illustrated in FIG. 1 and FIG. 2, this engine is provided with an OHC valve train, and each cylinder is equipped with intake valves 51*a*,51*b* and exhaust valves 52*a*,52*b*. Further, a fuel injection valve 53 is arranged approximately on a central axis of each cylinder.

Figure 3:
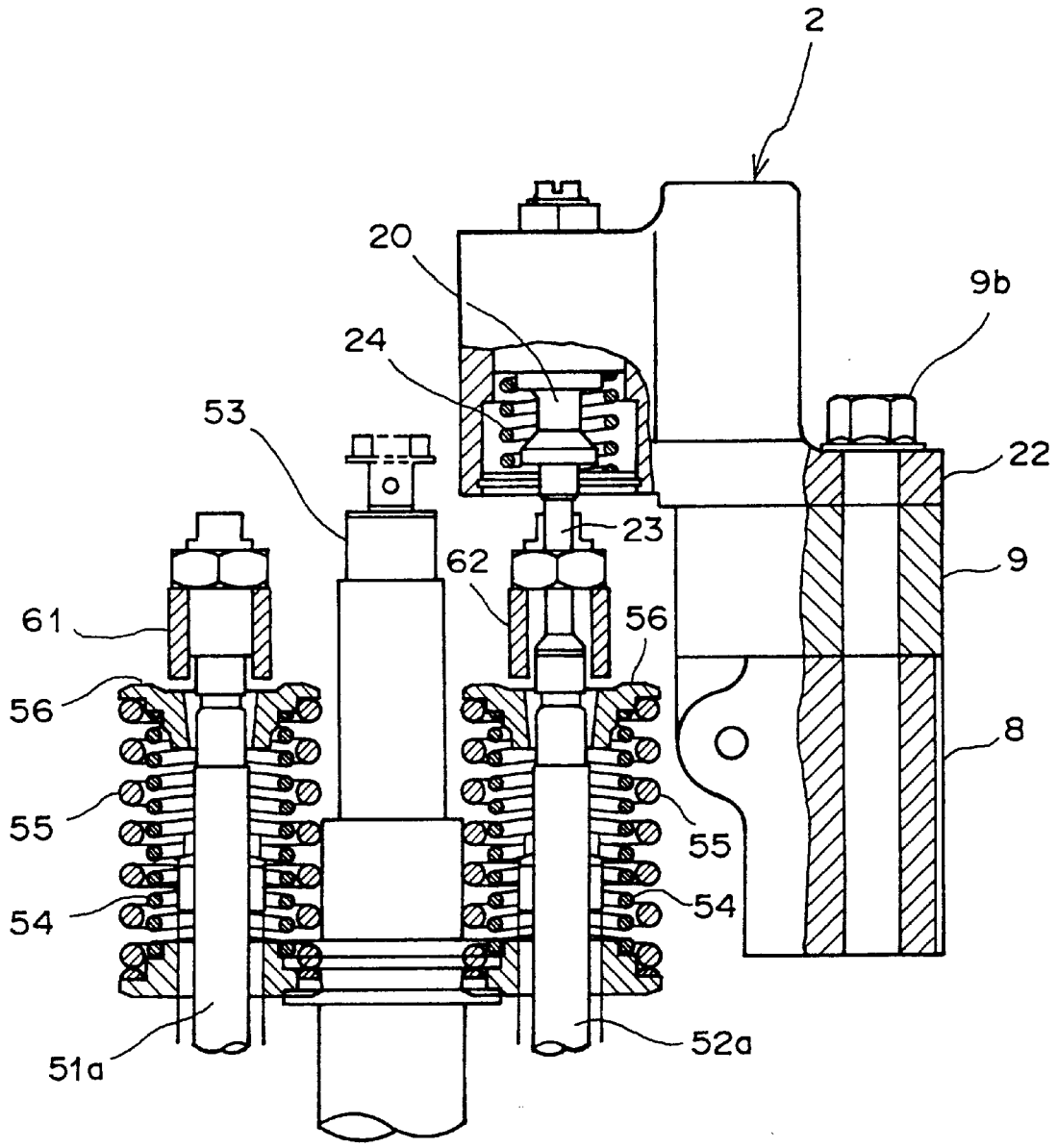
FIG. 3 is a schematic view showing the construction of an essential part of the engine-brake assisting system according to the one embodiment of the present invention, and is a figure as viewed in the direction of arrow B of FIG. 1.

As is shown in FIG. 2, a valve bridge 62 is arranged over the exhaust valves 52*a*,52*b*, and a valve bridge 61 is also disposed likewise over the exhaust valves 51*a*,51*b* (see FIG. 3).

Over these valve bridges 61,62, an intake rocker arm 41 and an exhaust rocker arm 42, both pivotally supported on a rocker shaft 40, are arranged respectively in such a way that these arms are maintained at one ends thereof in contact with the corresponding bridges. During a normal operation of the engine, the intake valves 51*a*,51*b* and the exhaust valves 52*a*,52*b* are opened and closed in accordance with operation of the corresponding rocker arms 41,42.

A camshaft 30 is provided with an intake cam 31 and an exhaust cam 32. These intake cam 31 and exhaust cam 32 are formed in such cam profiles as making the respective rocker arms 41,42 operate at a timing suited for the normal operation.

A description will next be made about the construction of an essential part of the system. As is illustrated in FIG. 1, the camshaft 30 is provided with an engine-brake assisting cam 33 at a location adjacent the intake cam 31 and the exhaust cam 32.

On a cylinder head 3, a hydraulic pressure producing unit 1 is also arranged to produce a desired hydraulic pressure responsive to operation of the engine-brake assisting cam 33. The hydraulic pressure producing unit 1 is provided, as shown in FIG. 2, with a master piston 10 driven by the engine-brake assisting cam 33, a master cylinder 11 accommodating the master piston 11 therein, and a master piston housing 12 defining the master cylinder 11.

Owing to this construction, the working fluid inside the master cylinder 11 is compressed when the master piston 10 is reciprocally driven by the engine-brake assisting cam 33. Incidentally, the engine-brake assisting cam 33 is formed in such a cam profile as driving the master piston 10 when the piston of the engine is located near the top dead center in a compression stroke.

As is illustrated in FIG. 1 and FIG. 2, an exhaust valve driving unit 2, which is constructed as a discrete unit from the hydraulic pressure producing unit 1, is arranged above the exhaust valve 52*a* in the cylinder head 3.

Figure 5:
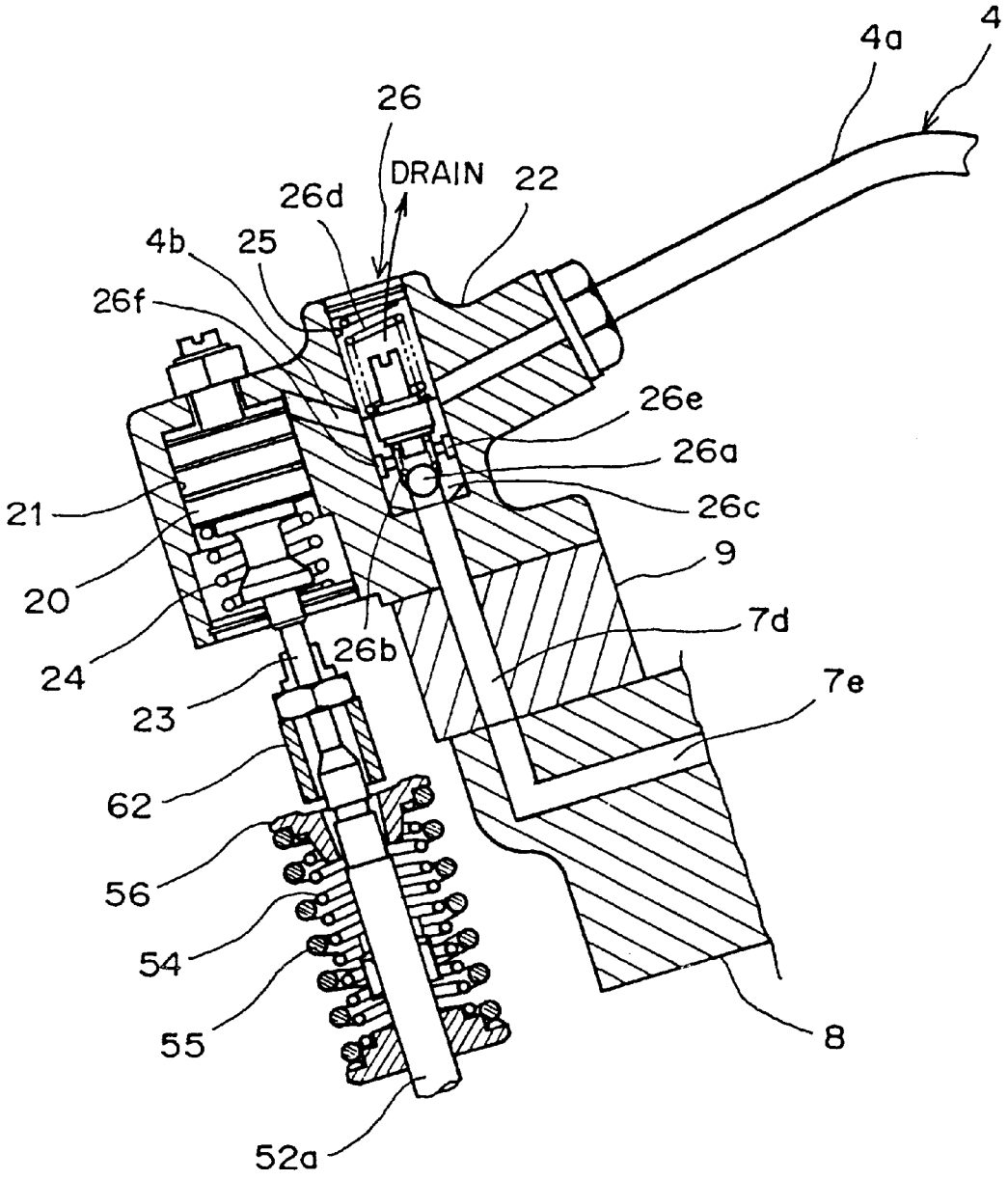
FIG. 5 is a schematic cross-sectional view depicting the construction of an essential part of the engine-brake assisting system according to the one embodiment of the present invention, and is a cross-sectional view taken in the direction of arrows V—V of FIG. 1.
Figure 6:
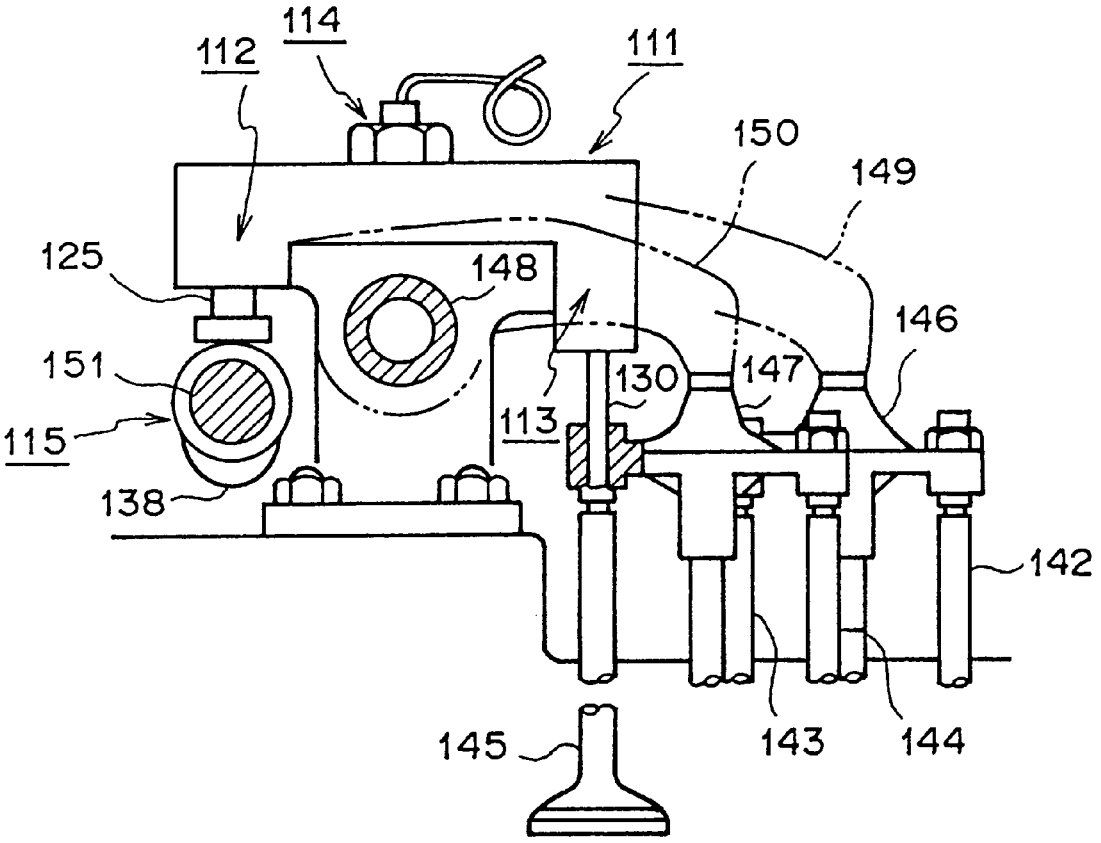
FIG. 6 PRIOR ART
FIG. 6 is a schematic illustration for describing an illustrative conventional engine-brake assisting system.
Figure 7:
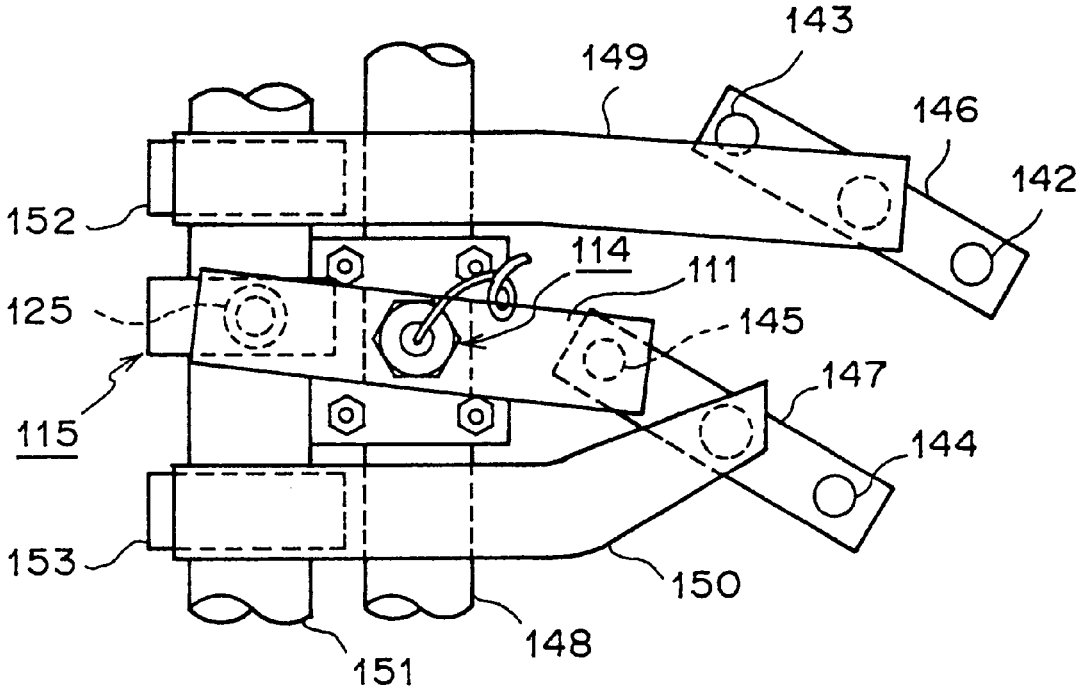
FIG. 7 PRIOR ART
FIG. 7 is a schematic illustration for describing the illustrative conventional engine-brake assisting system.
Figure 8:
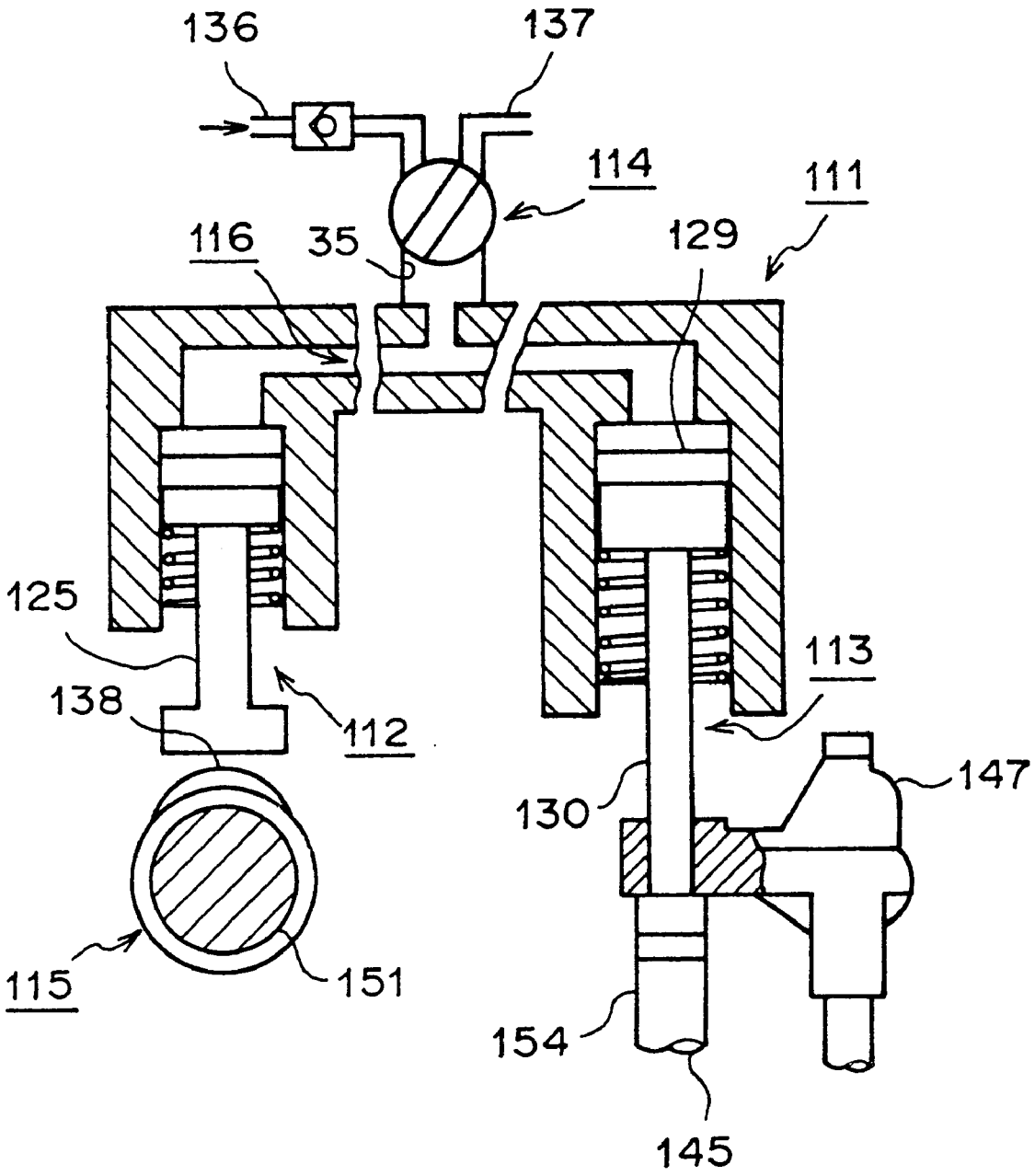
FIG. 8 PRIOR ART
FIG. 8 is a schematic illustration for describing the illustrative conventional engine-brake assisting system.

The exhaust valve driving unit 2 is arranged to make the exhaust valve 52*a* open at a timing different from an opening timing by the exhaust cam 32 and, as depicted in FIG. 5, the unit 2 is provided with a slave piston 20 driven by a pressure of working fluid supplied from the hydraulic pressure producing unit 1, a slave cylinder 21 accommodating the slave piston 20 therein, and a slave piston housing 22 defining the slave cylinder 21.

These master cylinder 11 and slave cylinder 21 are connected together via a hydraulic circuit member 4 as shown in FIG. 1 and FIG. 2. A working fluid supply unit 80 is composed of the hydraulic pressure producing unit 1, exhaust valve driving unit 2, and hydraulic circuit member 4.

As is depicted in FIG. 1 and FIG. 5, the hydraulic circuit member 4 is constructed of a working fluid supply line 4*a* and another working fluid supply line 4*b* formed within the slave piston housing 22. The working fluid supply line 4*a* is connected at one end thereof to the master cylinder 11, and the working fluid supply line 4*b* is connected at one end thereof to the slave cylinder 21.

These working fluid supply lines 4*a* and 4*b* are connected together via a control valve 26 to be described subsequently herein. By the function of this control valve 26, a state of connection between the working fluid supply lines 4*a* and 4*b* is controlled. Incidentally, the hydraulic circuit member 4 is arranged astride the rocker shaft 40 as depicted in FIG. 2.

In this system, the hydraulic pressure producing unit 1 and the exhaust valve driving unit 2 are constructed as discrete units relative to each other and are connected together by the hydraulic circuit member 4, thereby reducing increases in the overall engine height and the engine weight.

In the conventional engine-brake assisting system, the master cylinder, the slave cylinder, and the working fluid line, which connects these master cylinder and slave cylinder together, are integrally constructed in the single housing, thereby leading to the problem that the overall engine height and the engine weight are considerably increased. The engine-brake assisting system according to the present invention can, however, be arranged without using such an integral housing, thereby making it possible to substantially reduce increases in the overall engine height and the engine weight.

Incidentally, a piston rod 23 is arranged underneath the slave piston 20 as depicted in FIG. 3 and FIG. 5, and a lower end of this piston rod 23 is in contact with an upper end of the exhaust valve 52*a*. Accordingly, when the slave piston 20 moves downward, the exhaust valve 52*a* is opened by way of the piston rod 23 irrespective of a state of operation of the exhaust rocker arm 42.

As is illustrated in the figures, a return spring 24 is arranged within the slave cylinder 21 so that the slave piston 20 is biased upward under biasing force of the return spring 24. When high-pressure working fluid is supplied to the slave cylinder 21 through the working fluid supply line 4*b*, a state of operation of the master piston 10 is transmitted to the slave piston 20 by way of the high-pressure working fluid, whereby the slave piston 20 is driven.

Designated at numerals 54,55 in the figures are both valve springs, while numeral 56 indicates a valve retainer.

The construction, which has been described above, is common to the individual cylinders, so that all the cylinders are constructed similarly.

As is depicted in FIG. 2, the camshaft 30 is rotatably supported by a cam journal (a lower member of a bearing) 8 and a cam cap (an upper member of the bearing) 9. Of these, the cam journal 8 is formed integrally with a rocker case (base member) 5 and, as illustrated in FIG. 1, the rocker case 5 is formed in such a shape as enclosing the individual cylinders.

Further, as is illustrated in FIG. 2, the exhaust valve driving unit 2 is mounted on an upper wall of the cam cap 9, and the slave piston housing 22 of the exhaust valve driving unit 2 is attached to the cylinder head 3 by bolts 9*a*,9*b* with the cam cap 9 interposed therebetween. The cam cap 9 with the exhaust valve driving unit 2 mounted thereon is in turn mounted on the cylinder head 3 by bolts 9*b*,9*c*. Namely, the exhaust valve driving unit 2 and the cam cap 9 are fastened together by the common bolts 9*b*,9*c*. This has made it possible to reduce the number of parts and also to reduce the assembling manhour.

In this case, it may be contemplated to form the cam cap 9 and the slave piston housing 22 as an integral element and then to fix the integral element on the cam journal 8 by bolts. In this case, the cam cap 9 and the slave piston housing 22 have to be formed of the same material. From the viewpoint of reducing the engine weight, on the other hand, there is a desire for the formation of the cam cap 9 and the slave piston housing 22 with a light material, for example, an aluminum material.

High rigidity is, however, required for the slave piston housing 22. In view of this requirement, an iron-base material such as cast iron is used for the slave piston housing 22. The engine weight is, therefore, considered to increase if the cam cap 9 and the slave piston housing 22 are integrated and formed of the same material.

From the requirement for such a reduction in the engine weight, a light-weight aluminum material is used for the rocker case 5 (namely, the cam journal 8). If the cam cap 9 and the slave piston housing 22 are integrated and the cam cap 9 is also constructed using an iron-base material such as cast iron as described above, the cam journal 8 and the cam cap 9 are formed of different materials. This is considered to make difficult the machining of a bearing portion of the cam shaft 30 and hence to make it difficult to increase the roundness of the bearing portion.

In the system of this embodiment, the rocker case 5 and the cam cap 9 are both formed of an aluminum material, thereby making it relatively easy to machine the bearing portion of the cam shaft 30 while achieving a weight reduction of the engine. Concerning the slave piston housing 22, on the other hand, it is formed of an iron-base material such as cast iron so that high rigidity is obtained. Further, as mentioned above, the cam journal 8 of the rocker case 5, the cam cap 9 and the slave piston housing 22 are all fastened by the common bolts 9*a*,9*b*, thereby achieving a reduction in the overall engine weight, a reduction in the number of parts and a reduction in the assembling manhour.

Incidentally, as is illustrated in FIG. 2, the rocker case 5 is formed in such a shape that a wall 5*a*, which is located on a side of the hydraulic pressure producing unit 1, is provided with a bottom wall 5*b* inwardly extending over the upper wall of the cylinder head 3. The bottom wall 5*b* is formed as a part of a bottom wall of a rocker compartment surrounded by the rocker case 5.

A positioning pin 70 is arranged extending through the bottom wall 5*b*. By this positioning pin 70, the mounting position of the hydraulic pressure producing unit 1 is specified relative to the rocker case 5.

The master piston 10 is arranged within the hydraulic pressure producing unit 1. This master piston 10 is driven by the engine-brake assisting cam 33 as mentioned above. There is, accordingly, a desire for the minimization of a mounting error between the engine-brake assisting cam 33 and the master piston 10.

On the other hand, direct mounting of the master piston housing 12 of the hydraulic pressure producing unit 1 on the cylinder head 3 leads to inclusion of a mounting error between the cylinder head 3 and the rocker case 5 in a mounting error between the engine-brake assisting cam 33 and the master piston 10. This means that the accuracy in mounting position between the engine-brake assisting cam 33 and the master piston 10 is reduced by the former mounting error.

As has been described above, the rocker case 5 in the system of this embodiment is therefore provided with the bottom wall 5*b* which is formed to inwardly extend over the upper wall of the cylinder head 3, and the master piston housing 12 is fixed on the bottom wall 5*b* of the rocker case 5. The rocker case 5 is accordingly the only member which exists between the engine-brake assisting cam 33 and the master piston 10, whereby the accuracy of the mounting position has been increased.

Although the bearing which rotatably supports the cam shaft 30, is arranged on the cam journal 8, this cam journal 8 is formed integrally with the rocker case 5. The mounting of the master piston housing 12 on the rocker case 5 has, therefore, minimized the cause for the occurrence of a mounting error.

Figure 4:
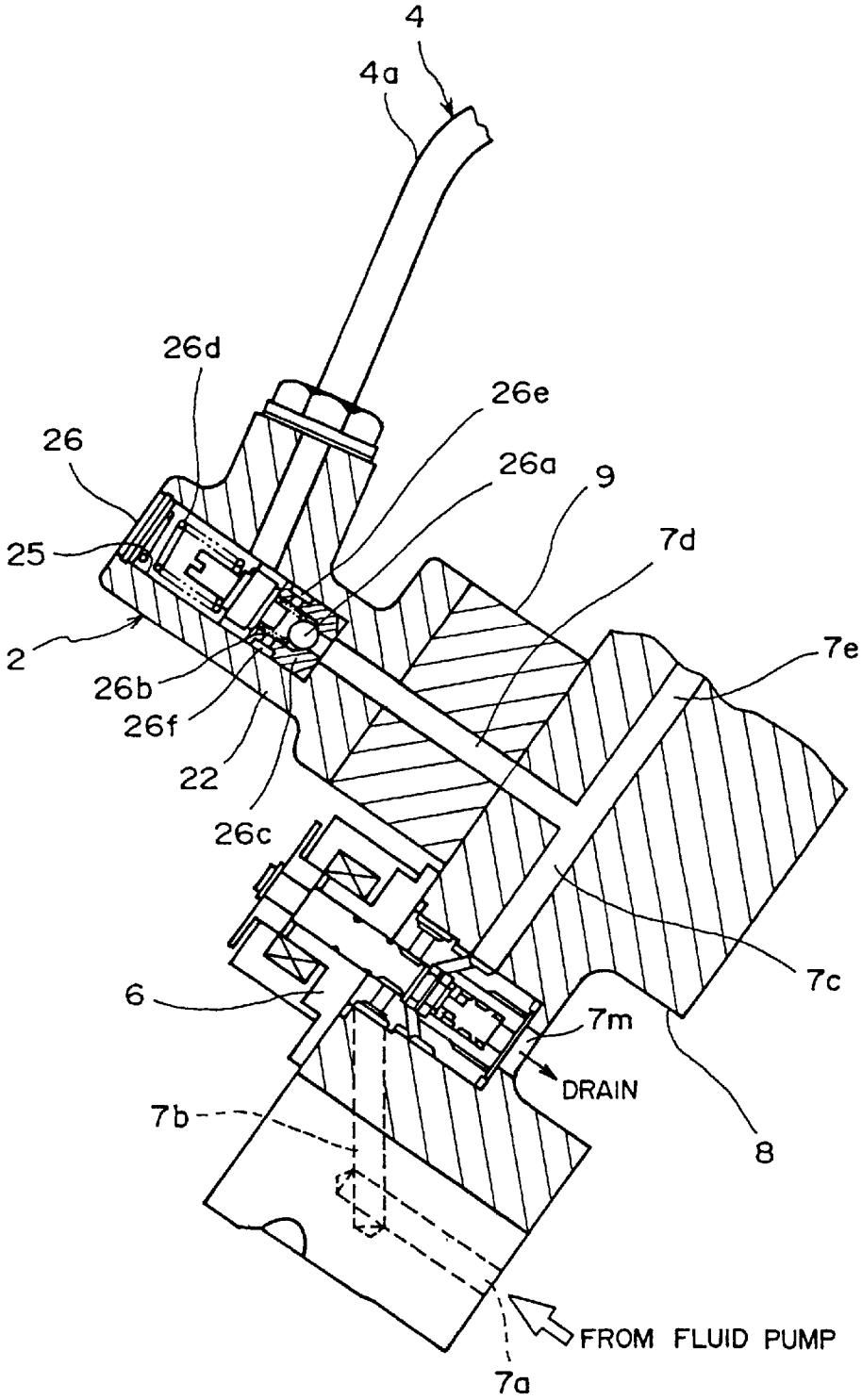
FIG. 4 is a schematic cross-sectional view depicting the construction of an essential part of the engine-brake assisting system according to the one embodiment of the present invention, and is a cross-sectional view taken in the direction of arrows IV—IV of FIG. 1.

A description will next be made about a supply path of working fluid in the engine-brake assisting system. As is illustrated in FIG. 4, fluid lines (main hydraulic pressure lines) 7*a*,7*b*,7*c* are formed in the cam journal 8 of the rocker case 5 to supply high-pressure working fluid from an unillustrated hydraulic pressure source to the hydraulic circuit member 4. Of these fluid lines, the fluid line 7*a* is connected to an unillustrated hydraulic pump, and a solenoid valve 6 is arranged between the fluid line 7*b* and the fluid line 7*c* to change over the engine-brake assisting system between an operation mode and a non-operation mode.

As is shown in FIG. 1, this solenoid valve 6 is constructed as a discrete element relative to any one of the hydraulic pressure producing unit 1, the exhaust valve driving unit 2, and the hydraulic circuit member 4, and is arranged adjacent to any one of the exhaust valve driving units 2 disposed in association with the individual cylinders.

Further, as depicted in FIG. 4, a drain line 7*m* is formed in the rocker case 5 to discharge working fluid still remaining inside the fluid line 7*c* and the like.

The solenoid valve 6 is a three-way valve, which normally (while being turned off) cuts off the fluid line 7*b* and the fluid line 7*c* from each other and connects the fluid line 7*c* and the drain line 7*m* in communication with each other. During operation of the engine-brake assisting system, it makes the fluid line 7*b* and the fluid line 7*c* communicate with each other when turned on by a control signal from an unillustrated controller (ECU).

The fluid line 7*c* is branched on a downstream side thereof into a fluid line (working fluid line) 7*d* and another fluid line (working fluid line) 7*e*. The fluid line 7*d* extends through the cam cap 9 and is connected to a control compartment 25 formed in the slave piston housing 22.

On the other hand, the fluid line 7*e* is connected via a further fluid line (working fluid line) 7*f* to a still further fluid line (working fluid line) 7*g* formed in the cylinder head as shown in FIG. 1 and FIG. 2. This fluid line 7*g* is arranged extending in the direction of a cylinder train of the engine. High-pressure working fluid is supplied from the fluid line 7*g* to the control compartment 25 of each slave piston housing 22, which is arranged in association with the corresponding one of the other cylinders, through fluid lines (working fluid lines) 7*h*,7*j*,7*k* arranged in the cam journal 8 of the same one cylinder.

Incidentally, the above-mentioned fluid lines 7*a*,7*b*,7*c* are arranged only for the cylinder which is provided with the solenoid valve 6.

Further, each control compartment 25 is provided with its own control valve 26. When working fluid is supplied to the control compartment 25, the working fluid supply pipe 4*a*, and the working fluid supply line 4*b* are connected in communication with each other by the control valve 26, and high-pressure working fluid is supplied to the working fluid supply pipe 4*a* and the working fluid supply line 4*b*.

The control compartment 25 is exposed to the atmosphere at a portion thereof located above the control valve 26. When working fluid is not supplied to the control compartment 25, the working fluid supply pipe 4*a* and the working fluid supply line 4*b* are exposed to the atmosphere.

Concerning the construction of the control valve 26, a brief description will now be made with reference to FIG. 4 and FIG. 5. This control valve 26 has a check ball 26*a*, a first return spring 26*b*, a valve element 26*c*, a second return spring 26*d* and the like. The valve element 26*c* is provided with fluid holes 26*e*,26*f*.

When high-pressure working fluid is supplied to the control compartment 25 through the fluid line 7*b* (or the fluid line 7*k*), the check ball 26*a* of the control valve 26 moves upward against biasing force of the first return spring 26*b* by the pressure of the working fluid so that the working fluid of high pressure flows into the valve element 26*c*.

On the other hand, the valve element 26*c* is biased downward by the second return spring 26*d* which is set at a greater spring constant than the above-mentioned first return spring 26*b*. When the high-pressure working fluid flows into the valve element 26*c* by way of the check ball 26*a*, the valve element 26*c* is caused to move upward by the high-pressure working fluid against the biasing force of the second return spring 26*d*.

When the valve element 26*c* moves upward over a predetermined distance, the fluid hole 26*e*, formed in the valve element 26 and the working fluid supply pipe 4*a*, are communicated with each other and the fluid hole 26*f* and the working fluid supply line 4*b* are also communicated with each other. The interior of the hydraulic circuit member 4 is, therefore, filled with the high-pressure working fluid.

When the solenoid valve 6 is turned off to stop the supply of the high-pressure working fluid, the fluid line 7*c* and the drain line 7*m* are connected in communication with each other so that the working fluid inside the individual high-pressure fluid lines 7*c*–7*k* is discharged. As the supply of the high-pressure working fluid to the control compartment 25 is stopped in this case, the check ball 26*a* in the control valve 26 moves downward under the biasing force of the first return spring 26*b* and the valve element 26*c* also moves downward by the biasing force of the second return spring 26*d*. As a result of the downward movement of the valve element 26*c* in the manner as described above, the working fluid supply lines 4*a*,4*b* are exposed to the atmosphere through the control compartment 25. Consequently, the working fluid remaining in the working fluid supply lines 4*a*,4*b* is promptly discharged so that the engine-brake assisting system can be surely changed over into the non-operation mode. It is, therefore, possible to improve the response of the engine-brake assisting system.

The engine-brake assisting system according to the one embodiment of the present invention is constructed as described above. During a normal operation of the engine, the solenoid valve 6 is, therefore, controlled to remain OFF by the unillustrated controller (ECU), and the fluid line 7*b* and the fluid line 7*c* are cut off from each other.

As a result, the high-pressure hydraulic fluid is not supplied to the hydraulic circuit member 4 of any one of the cylinders and, even when the master piston 10 is driven by the engine-brake assisting cam 33, the slave piston 20, therefore, remains non-operated. The exhaust valve 52*a* is accordingly opened and closed in accordance with the cam profile of the exhaust cam 32.

Namely, during a normal operation of the engine, turning-off of the solenoid valve 6 allows the intake valves 51*a*,51*b* and the exhaust valves 52*a*,52*b* to be opened and closed at normal valve-opening timings corresponding to the cam profiles of the intake cam 31 and the exhaust cam 32, respectively.

During operation of the engine-brake assisting system, on the other hand, an injection of fuel by the fuel injection valve 53 is first stopped based on a command signal from ECU. Approximately concurrently with this, the solenoid valve 6 is turned on by a command signal from ECU to communicate the fluid line 7*b* and the fluid line 7*c* with each other. As a consequence, at the exhaust valve driving unit 2 located adjacent the solenoid valve 6, the high-pressure working fluid is supplied from an unillustrated fluid pump to the control compartment 25 through the fluid lines 7*a*–7*c* and the fluid line (branch line) 7*d*.

At each of the other exhaust valve driving units 2, which are not located adjacent the solenoid valve 6, the working fluid is supplied from the fluid line 7*e* to the fluid line 7*g*, which is arranged extending in the direction of the cylinder train through the cylinder head 3, through the fluid line 7*f*. The high-pressure working fluid is then supplied from the fluid line 7*g* to the control compartment 25 through fluid lines (branch lines) 7*h*,7*j*,7*k* and the like which are arranged in the cam journal 8 of each cylinder.

When the high-pressure working fluid is supplied to the control compartment 25 of each cylinder, the check ball 26*a* in the control valve 26 is caused to move upward under the pressure of the working fluid against the biasing force of the first return spring 26*b*, and the high-pressure working fluid flows into the valve element 26*c*.

Further, when the high-pressure working fluid flows in the valve element 26*c*, the valve element 26*c* moves upward against the biasing force of the second return spring 26*d*. Accordingly, the fluid hole 26*e* formed in the valve element 26 and the working fluid supply line 4*a* are communicated with each other and the fluid hole 26*f*, and the working fluid supply line 4*b* are also communicated with each other, whereby the hydraulic circuit member 4 is filled with the high-pressure working fluid.

When the master piston 10 is driven in accordance with the engine-brake assisting cam 33 in the hydraulic pressure producing unit 1, the high-pressure, working fluid within the master cylinder 11, is compressed further and delivered to the slave cylinder 21 through the working fluid supply lines 4*a*,4*b*. Incidentally, when the internal pressure of the working fluid supply lines 4*a*,4*b* becomes equal to the internal pressure of the fluid lines 7*d*,7*k*, the check ball 26*a* moves downwards under the biasing force of the first return spring 26*b* so that the hydraulic fluid is confined in the working fluid supply lines 4*a*,4*b*.

At the exhaust valve driving unit 2, on the other hand, the slave piston 20 is driven against the biasing force of the return spring 24 under the pressure of the working fluid delivered from the hydraulic pressure producing unit 1, whereby the exhaust valve 52*a* is opened by way of the piston rod 23.

As has been described above, the engine-brake assisting cam 33 is formed in such a cam profile as driving the master piston 10 when the piston of the engine is located near the top dead center in a compression stroke. Accordingly, the exhaust valve 52*a* is opened near the top dead center of the piston in a compression stroke.

During operation of the system of this embodiment, the engine as a whole, therefore, performs an operation as will be described next. First, an injection of fuel by the fuel injection valve is stopped responsive to a control signal from ECU. In an intake stroke, the intake valves 51*a*,51*b* are opened as usual to introduce inducted air. In a compression stroke, the intake valves 51*a*,51*b* and the exhaust valves 52*a*,52*b* are both closed also as in an ordinary operation to compress inducted air within the cylinder.

When the piston then moves close to the top dead center, the exhaust valve 52*a* is opened, as mentioned above, so that the compressed inducted air is exhausted by way of the exhaust valve 52*a*. As a result, the repulsive force of the inducted air compressed in the compression stroke no longer acts on the piston and in an expansion stroke, no force acts in such a direction as pushing down the piston.

Subsequent to the exhaustion of the compressed air, the exhaust valve 52*a* is closed to keep the cylinder in a sealed state during the expansion stroke. As a consequent, force is produced to prevent the piston from moving downward so that engine brake force is applied.

Next, when the piston reaches near the bottom dead center and the engine advances to an exhaust stroke, the exhaust valves 52*a*,52*b* are opened as usual to bring the internal pressure of the cylinder close to atmospheric pressure. When the piston subsequently reaches near the top dead center, an intake stroke is started again.

Brake forces in such compression strokes and expansion strokes successively act on the piston, whereby the ability of engine brake is significantly increased. In other words, the engine is caused to perform pumping operation as negative work so that kinetic energy of the vehicle is absorbed and converted into braking force.

On the other hand, to change over the operation mode of the engine-brake assisting system from the operation mode to the non-operation mode, the solenoid valve 6 is turned off by ECU to cut off the fluid line 7*b* and the fluid line 7*c* from each other and at the same time, to communicate the fluid line 7*c* with the drain line 7*m*. As a result, the working fluid inside the fluid lines 7*c*–7*k* is promptly discharged. This cuts off the supply of the working fluid to the control compartment 25 so that the valve element 26*c* of the control valve 26 moves downward. The interiors of the working fluid supply lines 4*a*,4*b* are, therefore, exposed to atmosphere through the control compartment 25. Accordingly, when the solenoid valve 6 is turned off, the working fluid remaining inside the hydraulic circuit member 4 is discharged and the operation of the engine-brake assisting system stops promptly.

In the engine-brake assisting system according to the present invention, the hydraulic pressure producing unit 1 (primarily, the master piston housing 12) and the exhaust valve driving unit 2 (chiefly, the slave piston housing 22) are constructed as discrete elements, and the hydraulic pressure producing unit 1 and the exhaust valve driving unit 2 are connected by the hydraulic circuit member 4. Increases in the overall engine height and the engine weight are therefore reduced.

Namely, the conventional engine-brake assisting system is accompanied by the problem that the overall engine height and the engine weight are substantially increased, because the master cylinder, the slave cylinder and the fluid line connecting these master cylinder and slave cylinder with each other are constructed in the integral housing. According to the system of this embodiment, the engine-brake assisting system can be arranged without using such an integral housing, so that increases in the overall engine height and the engine weight are minimized.

In the system of this embodiment, the rocker case 5 is formed into the shape that the rocker case 5 is provided with the bottom wall 5*b* extending inwardly over the upper wall of the cylinder head 3, and the master piston housing 12 is fixed by the positioning pin 70 arranged extending the bottom wall 5*b*. The accuracy of the mounting position of the master piston housing 12 has therefore been increased.

In other words, the cam journal 8 is formed integrally with the rocker case 5 and the master piston housing 12 is positioned relative to the rocker case 5, as mentioned above. The accuracy of the relative mounting positions between the engine-brake assisting cam 33 and the master piston housing 12 has therefore been improved.

In the system of this embodiment, the cam journal 8 of the rocker case 5, the cam cap 9 and the slave piston housing 22 are fastened by the common bolts 9*b*,9*c*. This has made it possible to make the engine lighter as a whole and also to reduce the number of parts and the assembling manhour.

In the system of this embodiment, the solenoid valve 6 is arranged as a discrete element relative to each of the hydraulic pressure producing unit 1, the exhaust valve driving unit 2, and the hydraulic circuit member 4 and is disposed adjacent the exhaust valve driving unit 2 of one of the cylinders, as described above. Although solenoid valves have heretofore been required as many as the number of cylinders in an engine, the system of this embodiment requires only one solenoid valve, leading to a reduction in manufacturing cost.

Further, the solenoid valve 6 is arranged as a discrete element relative to each of the hydraulic pressure producing unit 1, the exhaust valve driving unit 2, and the hydraulic circuit member 4, so that the hydraulic pressure producing unit 1, the exhaust valve driving unit 2, and the hydraulic circuit member 4 can be used as common parts by the individual cylinders. This has also made it possible to reduce the manufacturing cost.

In addition, a working fluid communicating line is composed of the fluid line 7*g* arranged extending in the direction of the cylinder train and the fluid lines 7*d*,7*e*,7*h*,7*j*,7*k* which connect the fluid line 7*g* and the control compartment 25 of each cylinder in communication with each other. There is, accordingly, an advantage that the single solenoid valve 6 can supply working fluid to the control compartments 25 of the plural cylinders.

At the exhaust valve driving unit 2 located adjacent the solenoid valve 6, working fluid is supplied from the solenoid valve 6 to the control compartment 25 through the fluid line 7*d*, and to the fluid line 7*g*, working fluid is supplied through the fluid lines 7*c*,7*e*,7*f*. It is, therefore, unnecessary to arrange any additional fluid line only for supplying working fluid to the fluid line 7*g*. Namely, if it is desired to directly supply working fluid from the solenoid valve 6 to the fluid line 7*g*, it is necessary to arrange an additional fluid line through the rocker case 5 so that the additional fluid line extends between the solenoid valve 6 and the cylinder head 3 in which the fluid line 7*g* is bored. According to the system of this embodiment, it is not necessary to arrange such an additional fluid line. As a matter of fact, it is difficult to arrange the fluid line 7*g* through the rocker case 5 in view of the structure of the rocker case 5. When the direct supply of hydraulic fluid from the solenoid valve 6 to the fluid line 7*g* is desired, the construction of fluid lines, as in the system of this embodiment, is extremely effective.

In this embodiment, the in-line engine with the individual cylinders arranged in series has been described. Application of the system according to the present invention is, however, not limited only to such in-line engines. It can also be applied to engines of other types, for example, to V-type engines, each of which is provided with two cylinder trains. In this case, it is possible to bring about similar advantageous effects as those mentioned above by arranging the solenoid valve 6 adjacent one of the exhaust valve driving units 2 arranged in association with individual cylinders in each of the cylinder trains (namely, by arranging one solenoid valve 6 per each cylinder train).

What is claimed is:

1. An engine-brake assisting system, comprising:

a camshaft arranged on a cylinder head of said engine;

an exhaust cam arranged on said camshaft for driving an exhaust valve via an exhaust rocker arm;

a rocker shaft rockably supporting said exhaust rocker arm thereon;

an engine-brake assisting cam arranged on said camshaft adjacent to said exhaust cam;

a hydraulic pressure producing unit for producing a desired hydraulic pressure responsive to actuation of said engine-brake assisting cam;

a hydraulic circuit member connected on a side of an end thereof with said hydraulic pressure producing unit and arranged astride said rocker shaft; and an exhaust valve driving unit to which said hydraulic circuit member is connected on a side of an opposite end thereof so that by the hydraulic pressure supplied from said hydraulic pressure producing unit, said exhaust valve is opened at a timing different from a valve-opening timing of said exhaust cam, said hydraulic pressure producing unit, said hydraulic circuit member, and said exhaust valve driving unit being constructed as discrete elements.

2. The system of claim 1, wherein said hydraulic pressure producing unit is arranged on a bottom wall of a rocker compartment in which said camshaft is accommodated.

3. The system of claim 2, wherein said bottom wall of said rocker compartment is formed as a bottom wall of a rocker case which is in turn formed integrally with a bearing for the camshaft.

4. The system of claim 3, wherein said exhaust valve driving unit is fastened together with an upper member of said bearing on said cylinder head by common bolts.

* * * * *